US009914034B2

(12) United States Patent
Lee

(10) Patent No.: US 9,914,034 B2
(45) Date of Patent: Mar. 13, 2018

(54) BATTING TEE

(71) Applicant: Donald M. Lee, Freehold, NJ (US)

(72) Inventor: Donald M. Lee, Freehold, NJ (US)

( * ) Notice: Subject to any disclaimer, the term of this patent is extended or adjusted under 35 U.S.C. 154(b) by 0 days.

(21) Appl. No.: 15/078,289

(22) Filed: Mar. 23, 2016

(65) Prior Publication Data

US 2016/0287962 A1 Oct. 6, 2016

Related U.S. Application Data

(60) Provisional application No. 62/142,035, filed on Apr. 2, 2015.

(51) Int. Cl.
*A63B 69/00* (2006.01)
*A63B 71/02* (2006.01)

(52) U.S. Cl.
CPC ..... *A63B 69/0002* (2013.01); *A63B 69/0091* (2013.01); *A63B 69/002* (2013.01); *A63B 69/0075* (2013.01); *A63B 69/0079* (2013.01); *A63B 2069/0008* (2013.01); *A63B 2071/026* (2013.01); *A63B 2208/0204* (2013.01); *A63B 2210/50* (2013.01); *A63B 2225/093* (2013.01)

(58) Field of Classification Search
CPC ..... A63B 69/0075; A63B 69/0002; A63B 2069/0008; A63B 2208/0204; A63B 69/002; A63B 69/0079
USPC ..... 473/417, 423, 451, 431, 438
See application file for complete search history.

(56) References Cited

U.S. PATENT DOCUMENTS

| | | | | | |
|---|---|---|---|---|---|
| 2,616,692 | A * | 11/1952 | Bird | A63B 69/0075 | 473/417 |
| 2,652,250 | A * | 9/1953 | Alder | A63B 69/0075 | 473/417 |
| 2,862,712 | A * | 12/1958 | Delia | A63B 69/0075 | 473/423 |
| 4,664,374 | A * | 5/1987 | Groves | A63B 69/0075 | 473/417 |
| 4,938,478 | A | 7/1990 | Lay | 273/26 R | |
| 4,989,867 | A | 2/1991 | Herrick | 273/29 A | |
| 5,203,558 | A | 4/1993 | An | 273/29 A | |
| 5,386,988 | A | 2/1995 | Sung et al. | 273/29 A | |
| 5,393,050 | A * | 2/1995 | Lloyd | A63B 69/0091 | 473/417 |
| 5,685,542 | A | 11/1997 | Weis | 273/29 A | |
| 5,797,810 | A | 8/1998 | Sandoval | 473/417 | |
| 5,957,788 | A | 9/1999 | Eze | 473/422 | |
| 6,551,204 | B1 | 4/2003 | Di Re | 473/417 | |
| 6,666,781 | B1 | 12/2003 | Illis | 473/453 | |
| 7,458,907 | B2 * | 12/2008 | Wang | A63B 69/0002 | 473/417 |
| 7,775,912 | B2 * | 8/2010 | Aguirre | A63B 69/002 | 473/423 |

(Continued)

*Primary Examiner* — Mitra Aryanpour
(74) *Attorney, Agent, or Firm* — Ostrolenk Faber LLP

(57) ABSTRACT

A batting tee that includes a return mechanism, a swing arm connected to the return mechanism to swing about a rotation axis, a strike target connected to the swing arm, and a base supporting the return mechanism and the swing arm, the return mechanism including a mechanical energy storage device that stores mechanical energy when the swing arm swings in one direction in response to a batter's striking of the strike target, and a damper that slows down the swinging of the swing arm in the opposite direction as the swing arm swings back by the force supplied by the mechanical energy storage device.

3 Claims, 16 Drawing Sheets

(56) References Cited

U.S. PATENT DOCUMENTS

| | | | | |
|---|---|---|---|---|
| 8,672,780 | B2 * | 3/2014 | Fournier | A63B 69/0075 473/417 |
| 8,734,274 | B1 * | 5/2014 | Hochberg | A63B 69/0002 473/417 |
| 8,814,727 | B2 | 8/2014 | Ramcharan | 473/417 |
| 2006/0035729 | A1 * | 2/2006 | Wang | A63B 69/0002 473/417 |
| 2007/0049426 | A1 | 3/2007 | Huang | 473/417 |
| 2009/0029803 | A1 * | 1/2009 | Lincoln | A63B 69/0075 473/417 |
| 2010/0016100 | A1 * | 1/2010 | Liu | A63B 69/0002 473/417 |
| 2014/0302948 | A1 * | 10/2014 | Holland | A63B 69/0075 473/417 |
| 2015/0231470 | A1 * | 8/2015 | Kanner | A63B 69/0002 473/417 |

* cited by examiner

FIG. 1H
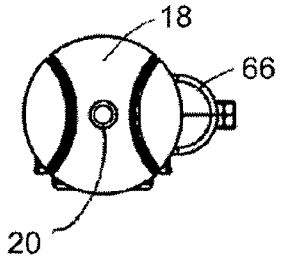
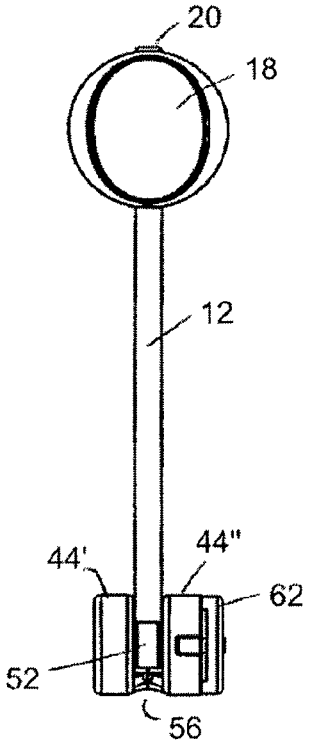
FIG. 1I
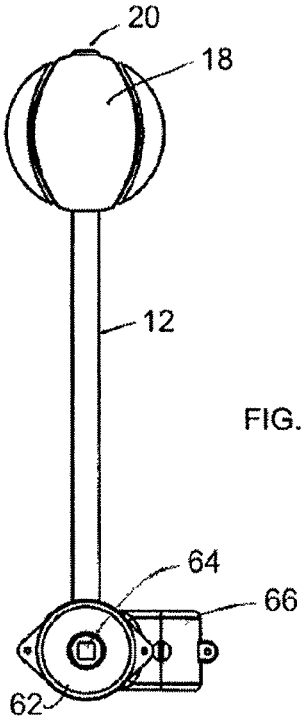
FIG. 1J

BATTING TEE

CLAIM OF PRIORITY

The present application claims priority to U.S. Provisional Application Ser. No. 62/142,035, filed Apr. 2, 2015, entitled Pivoting Baseball/Softball Tee with Slow Return Mechanism, which is hereby incorporated by reference.

FIELD OF THE INVENTION

The present invention relates to a batting tee, and in particular to a batting tee with a swing arm and an automatic and damped return mechanism.

BACKGROUND OF THE INVENTION

A typical batting tee includes a base, and an elongated stand attached to the base, which includes a cradle or the like feature for receiving a ball, such as a baseball or a softball.

In order to practice batting, a ball is placed in the cradle for the batter to hit with a bat. Thereafter, another ball could be placed in the cradle for another hit, or the same ball could be recovered and placed in the cradle for another hit if only one ball is available, for example.

To recover the ball, a batter who is practicing alone, would have to leave the location of the tee, recover the ball, place the ball back in the cradle and then hit the ball again. The recovery process is time consuming, tiring, and, unlike batting, "boring" for the practicing batter. Thus, it has been observed that a young batter who is practicing alone, tends to cut his practice short when ball recovery after every hit is necessary.

To overcome this problem, a batting tee with an automatic return mechanism has been proposed by Huang, US 2007/0049426.

Huang discloses a batting tee that includes a base, a height adjustable post attached to the base, a swing mechanism, a return mechanism located at the top of the post, a rod axially connected to the swing mechanism, and a baseball connected to an end of the rod. The return mechanism of Huang includes a mechanical energy storage device such as a spring. When the baseball is stricken by the batter, the rod is angularly displaced, and then the baseball is returned to its standby position by the return mechanism ready for the next swing.

In the tee proposed by Huang, the rod is returned to its standby position when the mechanical energy storage device releases the mechanical energy of the batter's strike (i.e., when the spring element of the return mechanism is unloaded).

In Huang's tee, the rod merely snaps back into the standby position to unload the energy stored in the mechanical energy storage device of the return mechanism. That is, the rate of the return of the arm to its standby position is not controlled.

SUMMARY OF THE INVENTION

It is an object of the present invention to provide a batting tee with an automated return mechanism and a strike target that does not become separated from the tee.

It is another object of the present invention to provide a batting tee that permits the practicing batter to practice in a confined area without the need for a net or a screen since the strike target (i.e. the ball) does leave the team upon receiving a strike from the bat.

Another object of the present invention is to damp at least the return of the strike target to its standby position to allow time for the batter to reset his/her batting stance to be ready for the next swing. The return of the tee to its upright position can be used as a timing mechanism. The controlled slow return of the tee will allow only brief periods (approximately 1-6 seconds) in between bat swings, which may improve hand/eye coordination.

Another objective is a batting tee that is portable and can be used in a basement, a garage or a pre-game location for warm up when there are no batting cages nearby.

A batting tee according to the present invention includes a swing arm having a distal end and a proximal end, a strike target integrated with the distal end of the swing arm, and a return mechanism with a rotatable axle having a rotation axis and connected to the proximal end of the swing arm, a mechanical energy storage device arranged to store mechanical energy when the swing arm swings about the rotation axis of the axle in one direction from a standby position to a deflected position that is angularly displaced from the standby position, and a damper arranged to damp swinging of the swing arm about the rotation axis of the axle in another direction opposite to the one direction from the deflected position to the standby position.

A batting tee according to the present invention may further include a stand having a base, a support pole connected to the base, and a telescopic support arm received by the support pole and arranged to telescopically move relative to the support pole. The base may have a central support hub with a plurality of radially extending and angularly spaced sockets, a central socket in which the support pole is received, and a plurality of spokes each received in a respective radially extending socket, each radially extending socket being angularly spaced from one other adjacent socket by one angle, and another adjacent socket by another angle that is different than the one angle.

The strike target may be re-attachably detachable from the distal end of the swing arm.

The mechanical energy storage device may include at least one torsion spring.

The axle maybe rotatably supported by a bracket. The bracket may be connected to the support pole of the base with, for example, an integrated collar.

The damper may be a rotary damper and the axle may include an extension at one end thereof that is connected to the rotary damper.

According to an aspect of the present invention, the mechanical energy storage device and the damper are selected so that when the deflected position is angularly displaced by ninety degrees from the standby position, it takes at least one second for the swing arm to swing back to the standby position. That is, the damped swing arm swings back to its standby position at the average speed of ninety degrees per second.

Preferably, the mechanical energy storage device and the damper are selected so that when the deflected position is angularly displaced by ninety degrees from the standby position, it takes at least one second and less than six seconds for the swing arm to swing back to the standby position. That is, the damped swing arm swings back to its standby position at an average speed in the range of fifteen degrees per second to ninety degrees per second.

The swing arm may have a fixed length, or a variable length.

A batting tee according to one embodiment may include a housing having a chamber with an open top and an open bottom, wherein the axle is rotatably mounted in the chamber, the housing including a gap that extends to the chamber to permit the swing arm to swing through the gap from the open top to the open bottom of the chamber. The housing may further includes an integrated collar to define a unitary body with the housing. The axle may include a lug located between its ends, the lug being connected to a proximal end portion of the swing arm. The housing may include two bores each receiving a respective end portion of the axle therein, and the mechanical energy storage device may include two torsion springs each located between the lug and a respective bore in the housing. The damper may resides on an exterior surface of the housing, and the axle may include an extension which passes through the housing and is connected to the damper.

Other features and advantages of the present invention will become apparent from the following description of the invention which refers to the accompanying drawings.

BRIEF DESCRIPTION OF THE DRAWING(S)

FIG. 1H is top plan view of the assembly shown in FIG. 1G, FIG. 1I is the first plan view thereof, and FIG. 1J is a side plan view thereof.

DETAILED DESCRIPTION OF PREFERRED EMBODIMENTS OF THE INVENTION

Figure 1A:
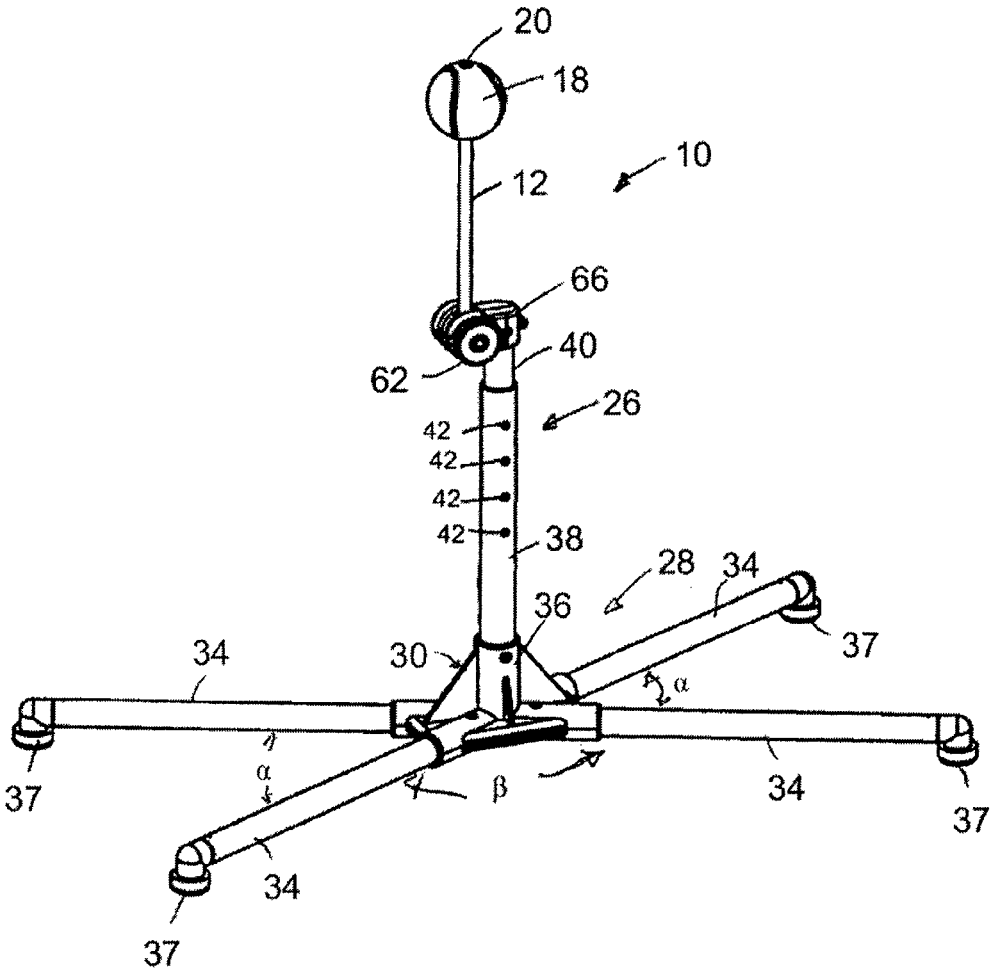
FIG. 1A depicts a first embodiment of a tee according to the present invention in an assembled state its swing arm in a standby position.
Figure 1B:
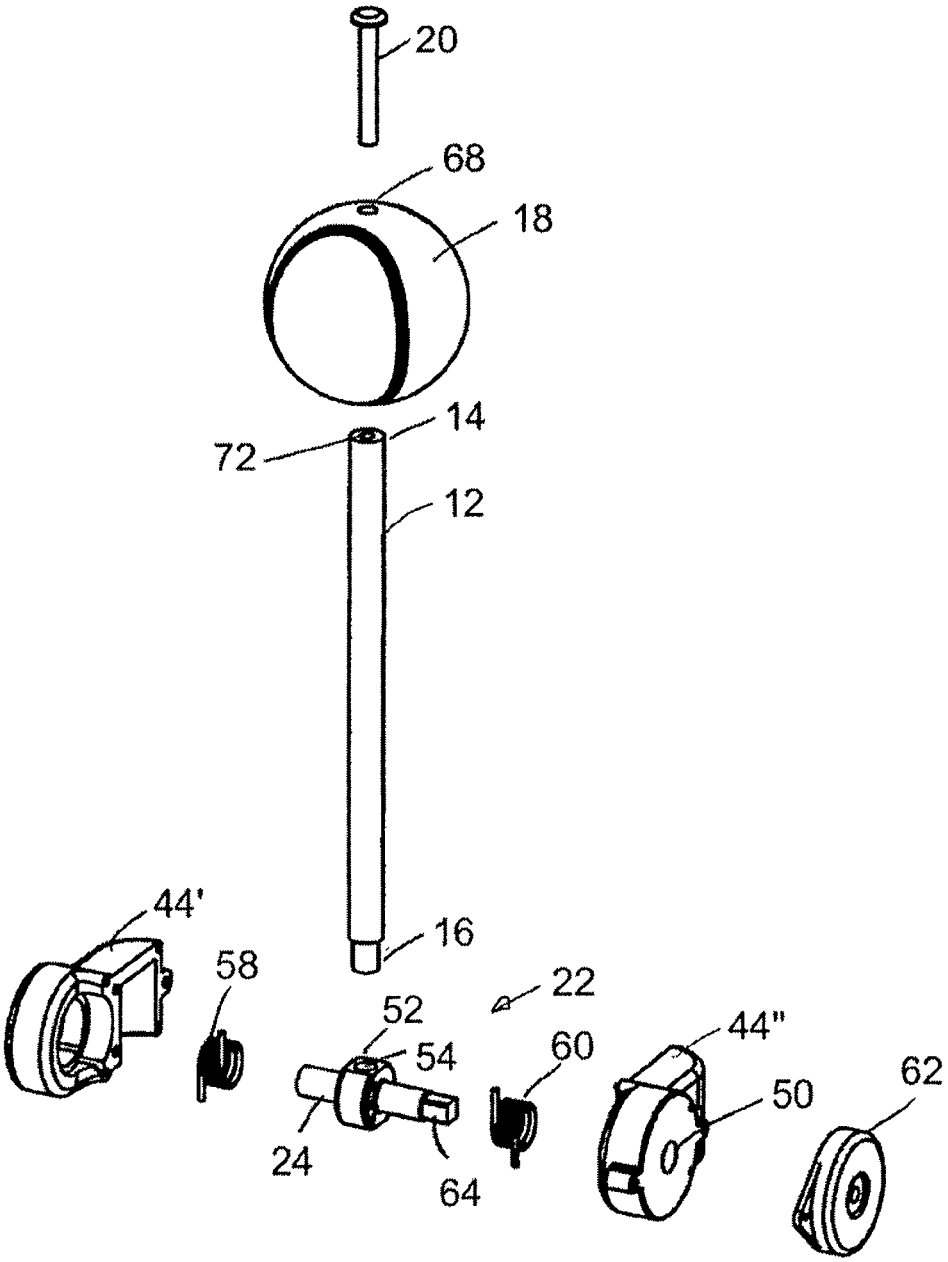
FIG. 1B depicts the strike target, the swing arm, and the damped return mechanism of the first embodiment in an disassembled state.

Referring to FIGS. 1A and 1B, a batting tee 10 according to the first embodiment of the present invention includes a swing arm 12 having a distal end 14, and a proximal end 16. A strike target 18 is attached/connected to the distal end 14 of the swing arm 12. The strike target 18 may be a baseball, a softball or any other ball.

The strike target 18 may be integrated with the distal end 14 of swing arm 12 or may be re-attachably detachable (reconnectably disconnectable) from the distal end 14 of the swing arm 12. For example, the strike target 18 may be connected to the distal end 14 of the swing arm 12 with a screw 20 or the like fastener.

A batting tee according to the present invention includes a damped return mechanism 22. The damped return mechanism 22 includes a rotatable axle 24 (see FIGS. 1B and 1D). The proximal end 16 of the swing arm 12 is integrated with the rotatable axle 24, permitting the swing arm 12 to swing about the longitudinal axis of the rotatable axle 24, i.e. the rotation axis of the axle 24.

In the preferred embodiment, the swing arm 12 may be a straight elongated body (for example, a tube or a rod) having a longitudinal axis which is normal to the longitudinal axis of the rotatable axle 24 when the swing arm 12 is connected to the rotatable axle 24.

In the first embodiment, the swing arm 12 has a fixed length.

Figure 1C:
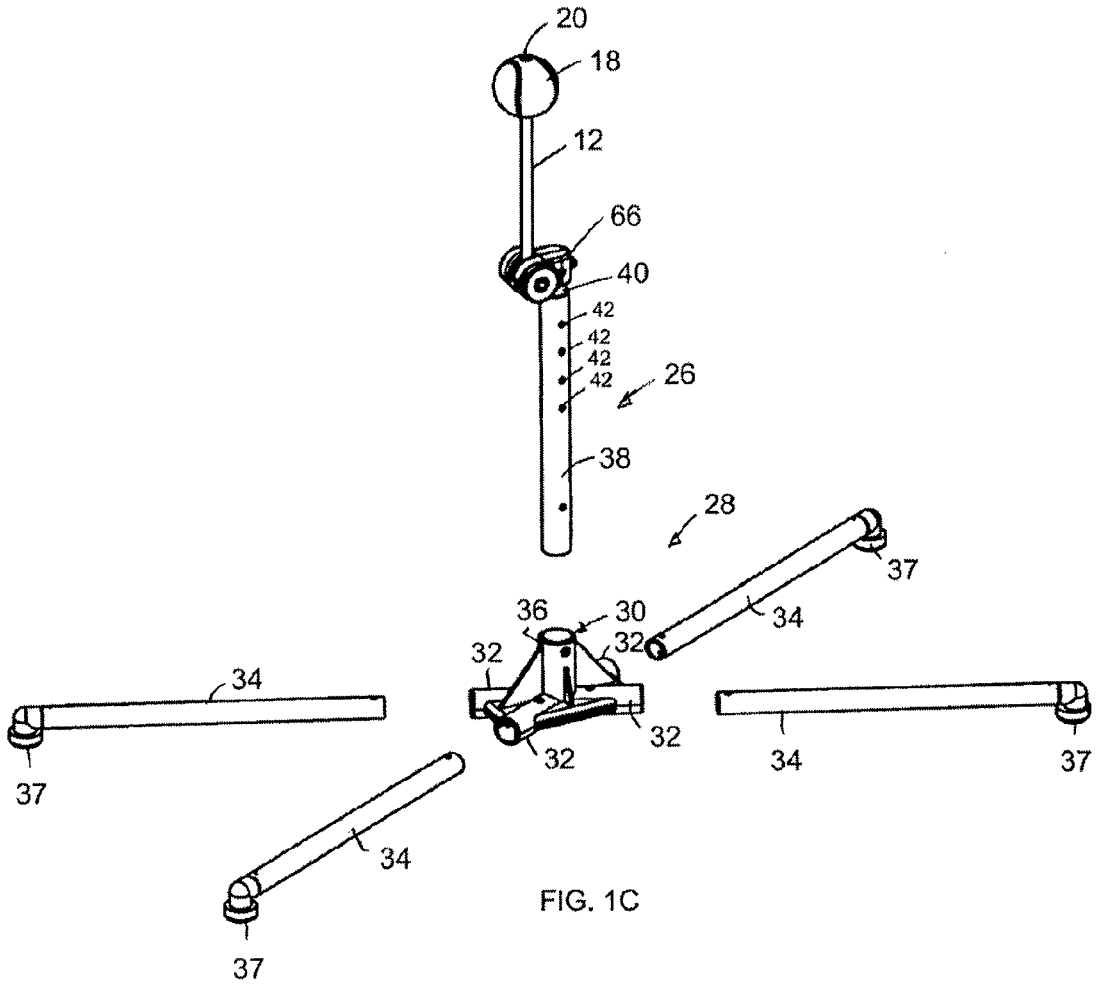
FIG. 1C depicts the first embodiment of the present invention in a partially disassembled state.

Preferably, the return mechanism 22 is supported on a stand 26. Stand 26 may include a base 28. Referring to FIGS. 1A and 1C, base 28 may include a central support hub 30. The central support hub 30 preferably includes a plurality of angularly spaced and radially extending sockets 32, for example, four angularly spaced sockets 32, which are arranged around a central axis of hub 30.

In the preferred embodiment, each socket 32 is located between two other adjacent sockets 32, and angularly spaced from one of the two adjacently located sockets 32 by a first angle $\alpha$ and angularly spaced from the other of the two adjacently located sockets 32 by another angle $\beta$, which is larger than the first angle.

Each socket 32 receives therein and may be fixed to an end portion of a respective spoke 34. Each spoke 34 may be an elongated tube. The opposite end of each spoke 34 may have a foot 37 or the like mounted thereon. Thus, spokes 34, when fixed to sockets 32, extend radially away from a central point of hub 30, and the feet 37 are arranged at four corners of an imaginary rectangle, whereby more support can be provided to resist tipping over in the direction of the strike than a direction transverse to the direction of the strike when the strike target 18 is stricken by a bat.

A central socket 36, which is preferably aligned with the central axis of the central support hub 30, extends in a direction that is normal to the central, longitudinal axes of all sockets 32. An end portion of a support pole 38 is received in the central socket 36. The support pole 38 is preferably a cylindrical tube. A telescopic support arm 40 (which may be a tube or a rod) is received inside of the support pole 38 and can move along the central, longitudinal axis of the support pole 38 relative to the support pole 38 in a telescopic fashion, whereby the distance between the top end of the support arm 40 and the top end of the support pole 38 can be varied to set the height of the strike target 18 relative to the ground.

A plurality of spaced holes 42 may be longitudinally arranged along the body of the support pole 38. A spring loaded plunger pin (not shown) or the like may be integrated with the support arm 40 and arranged to be received inside of a hole 42, whereby the support arm 40 can be fixed in position relative to the support pole 38.

Alternatively, instead of a spring loaded plunger pin, a screw or the like may be used to fix the support arm 40 in position relative to the support pole 38. In this way, the height of the top end of the support arm 40 can be adjusted selectively.

It should be noted that the mechanism described herein for setting the height of the top end of the support arm 40 is not critical, and any other suitable mechanism can be used without deviating from the invention. For example, Huang (US 2007/0049426) discloses a screw to set the height of a telescopic arm, which could be used to set the height in a tee according to the present invention.

According to one aspect of the present invention, the spokes 34 are fixed to sockets 32 with a selectively releasable device such as a spring loaded plunger pin, whereby the spokes 34 can be assembled or disassembled with relative ease. That is, the spokes 34 may be re-attachably detachable (disconnectably reconnectable) to sockets 32.

Similarly, support pole 38 may be fixed to central socket 36 with a releasable device such as a spring loaded plunger pin, whereby support pole 38 may be assembled or disassembled with relative ease. That is, the support pole 38 may be re-attachably detachable (disconnectably reconnectable) to the central socket 36.

Through re-attachability (reconnectability) of its parts after disassembly, a batting tee according to the first embodiment, can be disassembled so that it may be transported easily from one location to another location in a disassembled state, and then assembled easily at the another location. Other devices such as screws may be used to permit re-assemblity after disassembly.

Figure 1D:
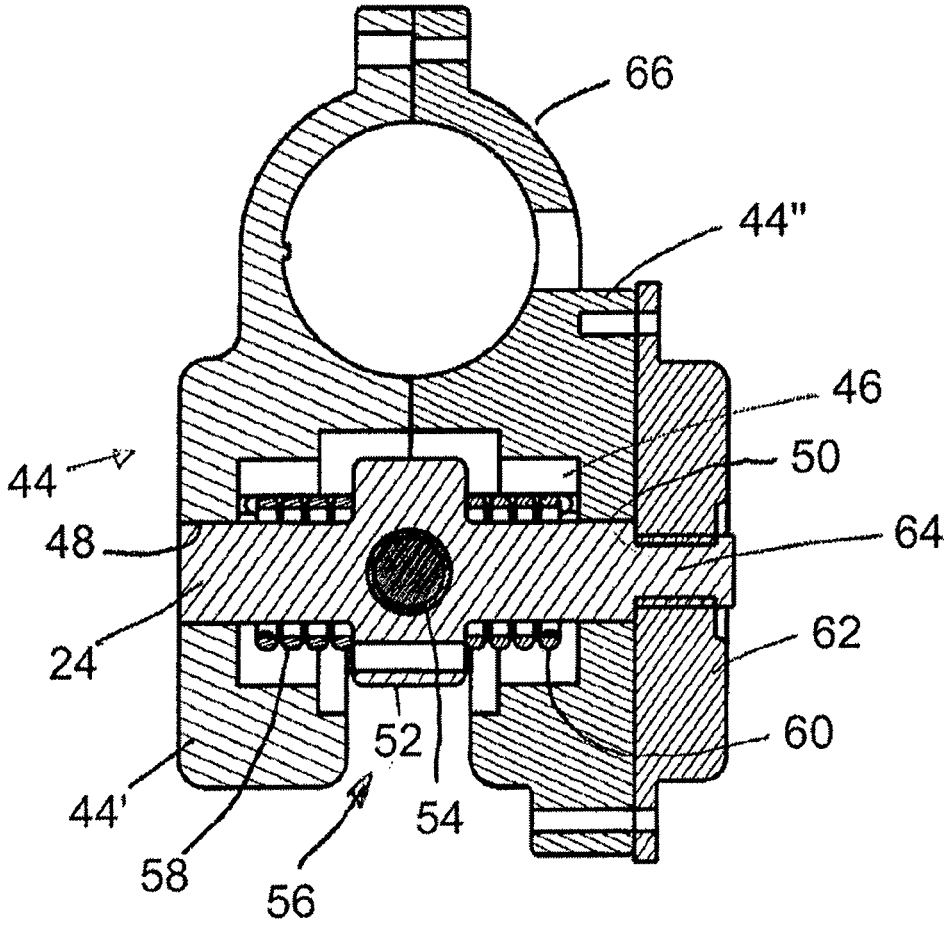
FIG. 1D depicts a cross-sectional view of the damped return mechanism of the first embodiment taken through the central, longitudinal axis of the rotatable axle and viewed from the top.

Referring now to FIGS. 1B and 1D, return mechanism 22 may be integrated with a two part housing 44. Housing 44 includes a chamber 46 having an open top and an open bottom. Axle 24 is rotatably mounted inside of chamber 46. Specifically, a first end portion of axle 24 is rotatably received in a first bore 48 defined in the first part 44' of housing 44, and a second end portion of axle 24 is rotatably received in a second bore 50 defined in the second part 44" of housing 24. The first part 44' and the second part 44" define a bracket that supports axle 24 when the two parts are assembled to form the housing 44. Screws or the like fasteners may be used to assemble housing 44 by connecting the first part 44' to the second part 44".

Axle 24 includes a central lug 52 located between its first end portion and its second end portion. Central lug 52 includes a threaded opening 54 therein, which may be a blind hole, having a central axis that is normal to the longitudinal axis (rotation axis) of axle 24. The first part 44' and the second part 44" are preferably integrated with screws or the like in order to support axle 24 in chamber 46. Once the first part 44' and the second part 44" are assembled, a gap 56 is defined which allows unobstructed access to the chamber 54 and the central lug 52.

The return mechanism 22 includes a mechanical energy storage device, which in the preferred embodiment may be at least one torsion spring. The mechanical energy storage device stores the energy of the strike, which stored energy generates the force to return the strike object to its original position after it is stricken.

Thus, in the first embodiment, a first torsion spring 58 is disposed around the axle 24 and located between its first end portion and central lug 52. A second torsion spring 60 is disposed around the axle 24 and located between the central lug 52 and the second end portion of the axle 24. Each torsion spring 58,60 is arranged so that rotation of the axle 24 in one direction (example clockwise) results in the storing of mechanical energy in the torsion springs 58, 60 (i.e. the loading of the torsion springs), which stored energy can then be used to rotate the axle 24 in the opposite direction (e.g. counterclockwise).

According to the present invention, at least the counter rotation of the axle 24 (i.e. its rotation after the torsion springs are loaded) is damped. In order to implement the damping, in the preferred embodiment, a damper 62 is connected to the axle 24. The damper 62 may be a rotary damper or a torque damper.

In the preferred embodiment, the second rotating end portion of the axle 24 includes an extension 64, which is in axial alignment with the central, longitudinal axis of the axle 24 about which the axle 24 rotates. The extension 64 extends out of the housing 44 and is connected to the damper 62. The damper 62 may be mounted to the exterior surface of the second part 44" of the housing 44. Through its connection to the damper 62, at least the counter rotation of the axle 24 is damped and thus slowed down. The damping slows down the swinging of the swing arm 12 under the force supplied by the loaded torsion springs.

The damper 62 may be selected to damp/absorb some of the energy of the strike in order to slow down the loading of the torsion springs 58, 60 (and the swinging of the swing arm 12) and provide some resistance to the strike, thereby creating the sensation of hitting a moving ball for the batter.

According to the present invention, the torsion springs 58,60 and the damper 62 are selected so that it takes at least one second and preferably no more than six seconds for the swing arm 12 to return to its original, standby position (before the strike and before the loading of the torsion springs 58,60 begins) from a deflected position which is at a ninety degree angular displacement relative to the original, standby position of the swing arm 12. That is, the damped swing arm 12 that is damped by damper 62 swings back to its standby position at an average speed in the range of fifteen degrees per second to ninety degrees per second. The slower rate of return (average speed) of the swing arm 12 from the deflected position to the standby position may be useful for training younger batters (e.g. ages 6-8) by providing more time to the batter to take a proper stance and coordinate.

It should be noted that the swing arm 12 may be deflected more than ninety degrees from its standby position (up to one hundred eighty degrees in the first embodiment) depending on the force of the strike received by the strike target 18. The average speed of the damped swing arm 12 should not be interpreted to mean that the range of motion of the swing arm 12 is limited to ninety degrees.

The damper 62 may have a preset damping constant to set the speed, or may be adjustable so that the rate of return of the swing arm 12 can be selected/set by the user or the trainer. Thus, a tee according to the present invention may have a damper 62 that is adjustable to damp the motion of the swing arm 12 from a deflected position to the standby position so that the return speed of the damped swing arm 12 from the deflected position to the standby position can be set in the range of fifteen degrees per second to ninety degrees per second.

In the preferred embodiment, the standby position of the swing arm 12 is vertical relative to the horizon, and the ninety degree angle referred to herein is parallel to the horizon.

In the preferred embodiment, the housing 44 may include an integrated collar 66, which is sized to fit around the support arm 40 whereby the housing 44 and the return mechanism 22 can be secured to the support arm 40, with a screw or the like to tighten the grip of the collar around the support arm 40. It should be noted that the collar 66 is located lateral to the chamber 46 in the embodiment disclosed herein. Instead of positioning the collar 66 lateral to the chamber 46, the collar 66 or a socket could be positioned below the chamber 46.

Figure 1E:
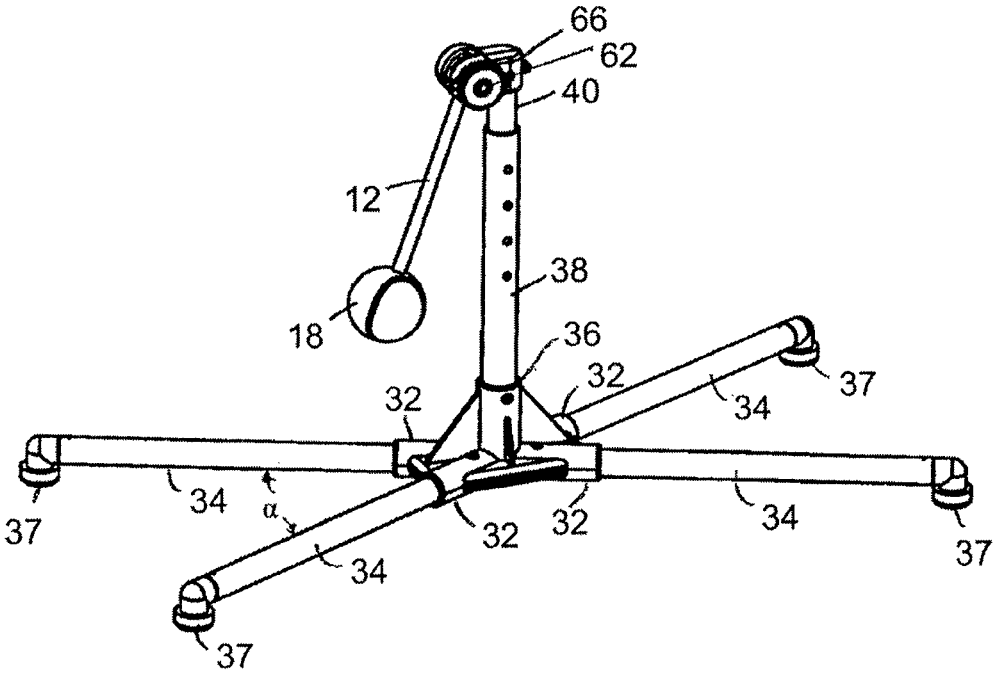
FIG. 1E depicts the first embodiment of the present invention with the swing arm in a deflected position.
Figure 1F:
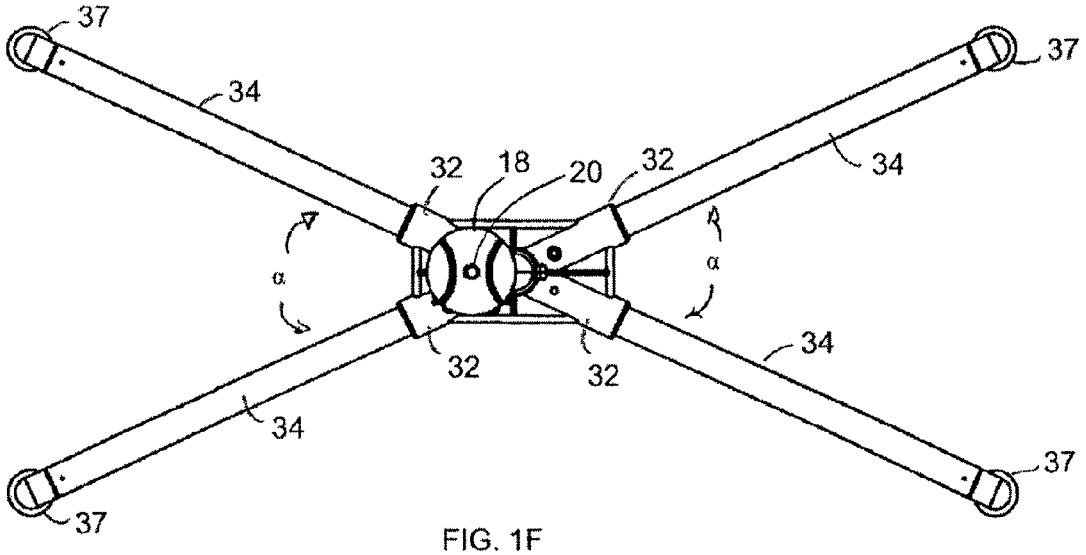
FIG. 1F is a top plan view of the first embodiment.
Figure 1G:
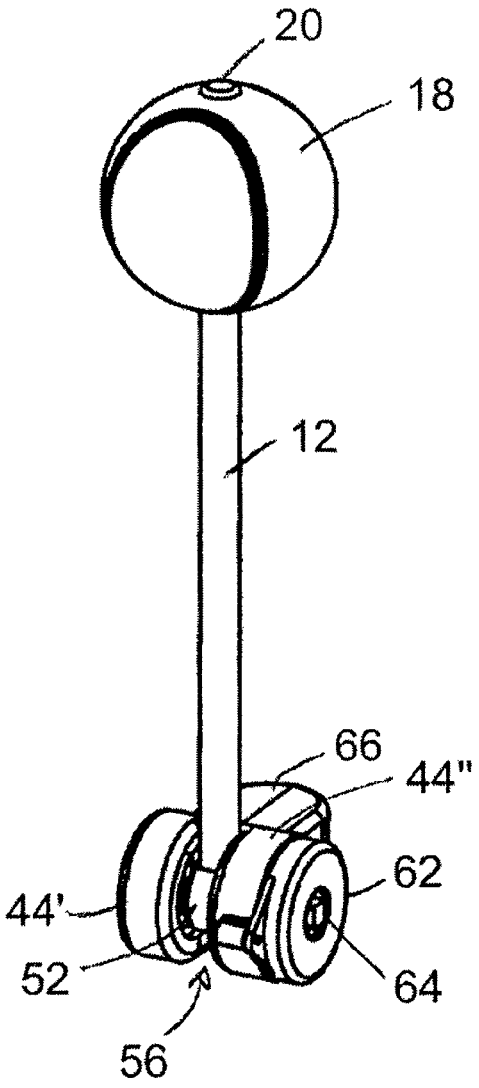
FIG. 1G is a perspective view of the strike target, the swing arm, and the damped return mechanism in an assembled state.

The swing arm 12 include a threaded exterior end located at its proximal end portion (FIG. 1B). The threaded exterior end is threadably received in the threaded opening 54 of the central lug 52 of the axle 24, whereby the swing arm 12 can be secured to the axle 24 in a detachably re-attachable (disconnectably reconnectable) manner. Thus, the striking of the strike target 18 can cause the rotation of the axle 24 and the loading of the torsion springs 58, 60. It should be noted that the gap 56 permits the swing arm 12 to swing through from a position above the open top of the chamber 46 to a position below the open bottom of the chamber 46 (see FIG. 1E) restricted to a plane of motion that passes through the gap 56 and is normal to the central, longitudinal axis of the axle 24. The plane of motion along which the swing arm 12 moves when swinging from an upright, standby position to a deflected position may be selected to bisect the first angle $\alpha$, whereby resistance to tipping over can be maximized, while the second angle $\beta$, which is wider that the first angle $\alpha$, permits more space for the batter to approach the tee.

Referring to FIG. 1B, the strike target 18 may have a bore 68 defined therein. The bore 68 passes through the center of the strike target 18 along a diameter thereof. A fastener 20 (e.g. a screw or a pin or the like) is provided to pass through the bore 68. The swing arm 12 may have a threaded portion or nut 72 located at its distal end 14 to couple to the fastener 20, whereby the strike target 18 can be secured to the distal end of the swing arm 12 in a reconnectably disconnectable (detachably re-attachable) manner. In this manner, the fastener 20 serves as an extension of the swing arm 12 to receive the energy of the strike from the strike target 18, and allows for the replacement of the strike target 18 with another strike target without destroying the connectability of the swing arm 12 to the strike target 18. Thus, for example, a baseball strike target 18 could be readily replaced with a softball strike target 18, or a worn out strike target 18 could be replaced with a new one.

It should be noted that, while preferred, it is not necessary to provide a bore 68 that passes through the center of the strike target 18. For example, as an alternative, a screw or the like could be mounted to the distal end of the swing arm 12, and the strike target 18 could be provided with a threaded opening to couple to the screw at the distal end 14 of the swing arm 12 without deviating from the present invention.

Figure 2A:
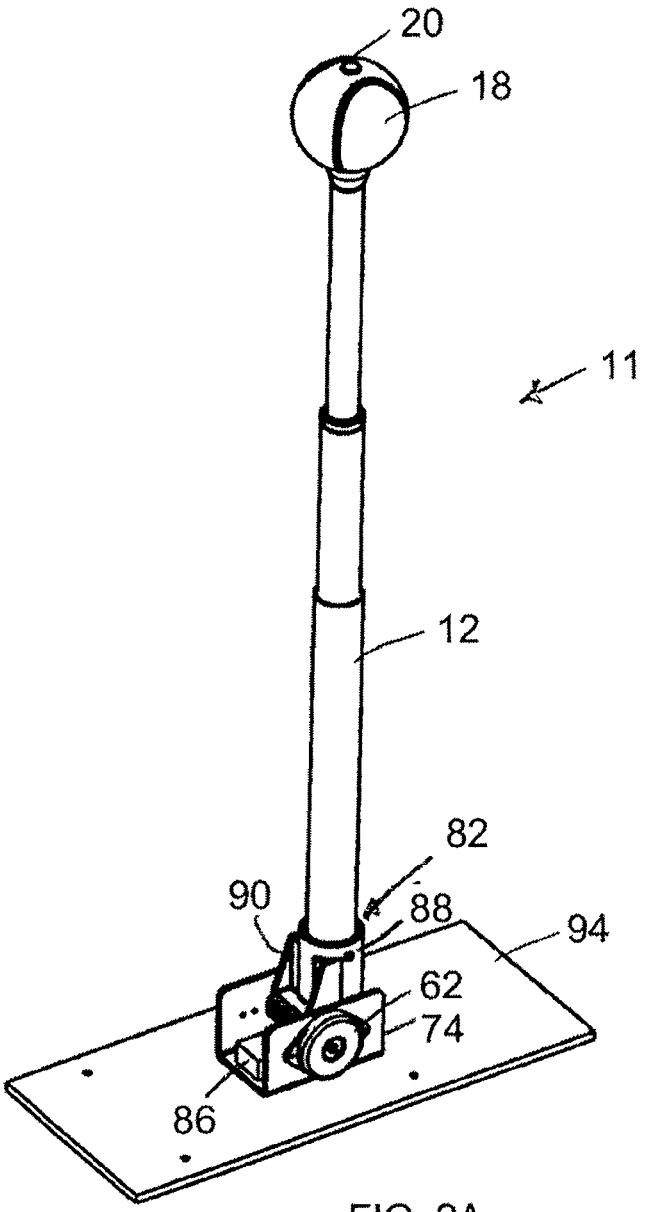
FIG. 2A is a tee according to a second embodiment of the present invention.
Figure 2B:
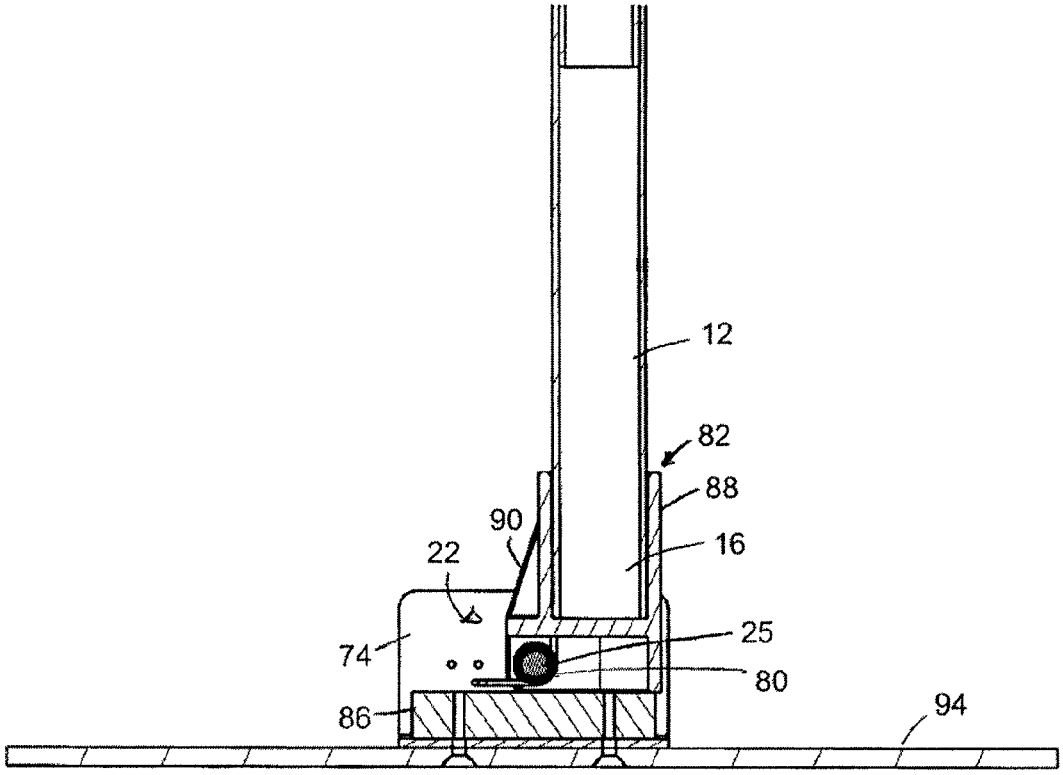
FIG. 2B is a partial cross-sectional view of the second embodiment taken along the central, longitudinal axis of its swing arm and viewed from the left side.

Referring now to FIG. 2A, in which like numerals identify like features, in a batting tee 11 according to the second embodiment, the swing arm 12 is a telescopic arm, whereby its length can be adjusted. Thus, unlike the swing arm 12 of the first embodiment, which has a fixed length, the length of the swing arm 12 of batting tee 11 can be selectively varied.

Figure 2C:
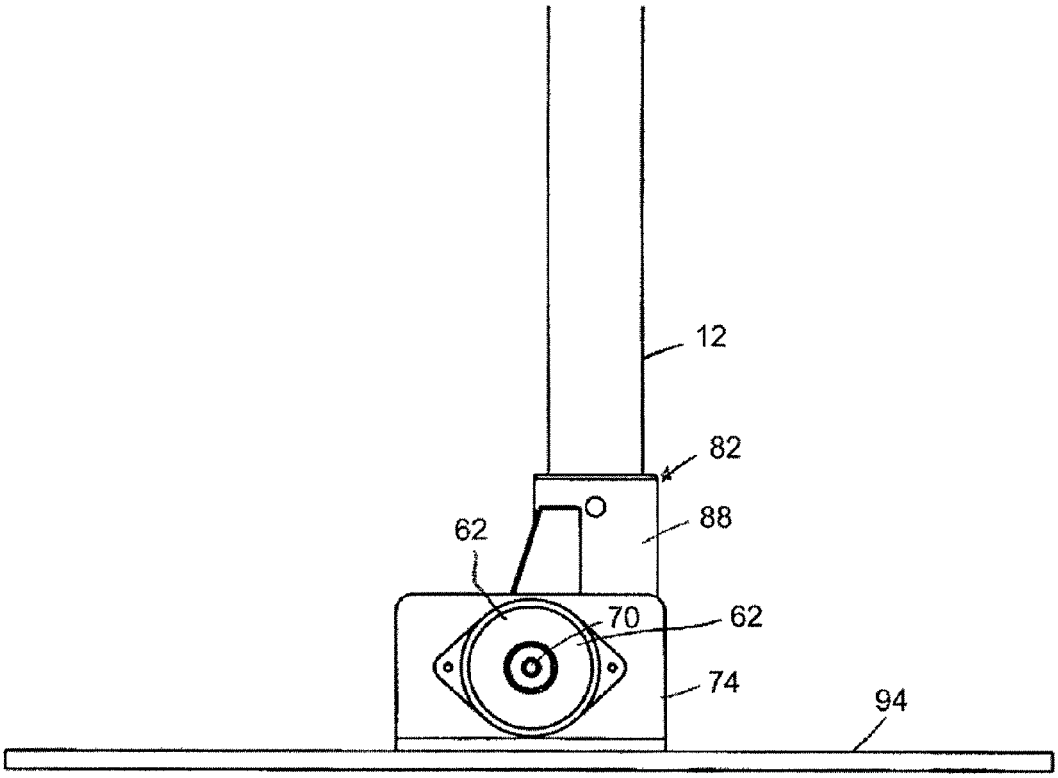
FIG. 2C is a partial left side view of the second embodiment.

Referring to FIG. 23, the proximal end 16 of the swing arm 12 is connected to a damped, spring-loaded, return mechanism 22. The return mechanism 22 in the second embodiment also includes a damper 62 (FIG. 2C), which may be a rotary or a torque damper connected to an axle 25 (FIG. 2D).

Figure 2D:
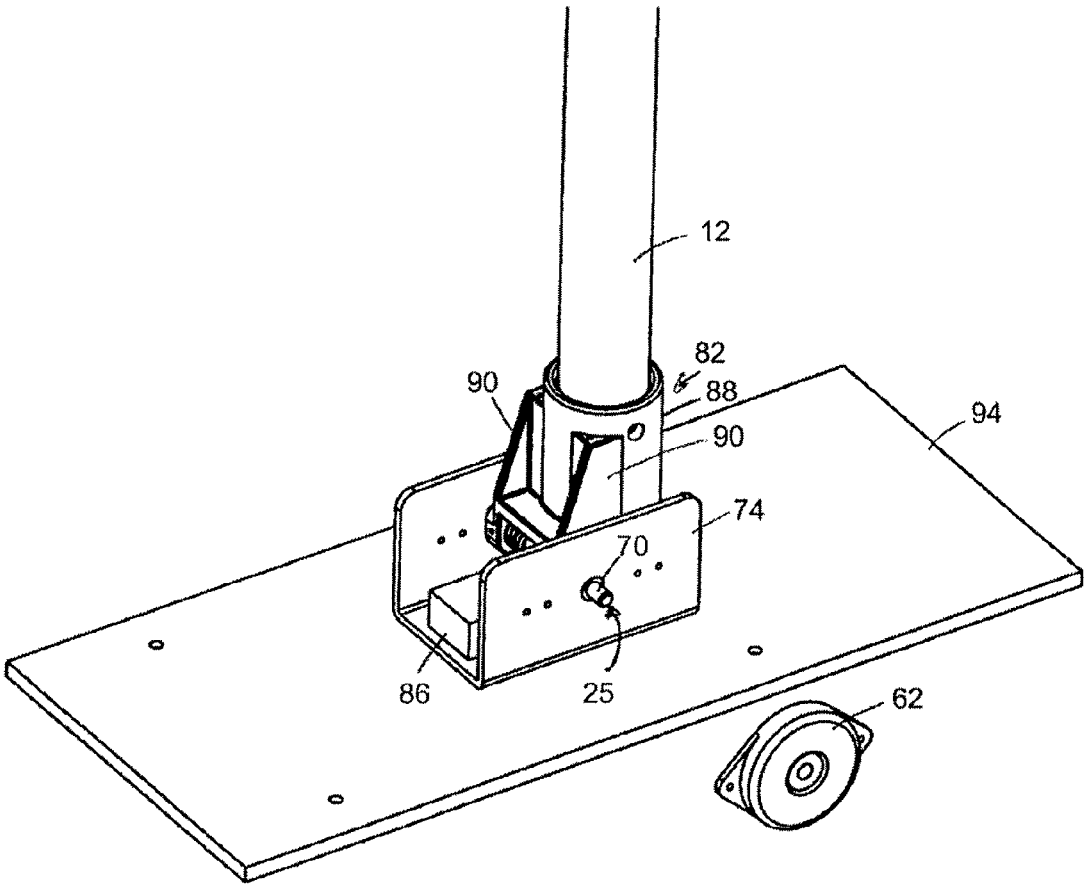
FIG. 2D is a partial top perspective view of the second embodiment.
Figure 2E:
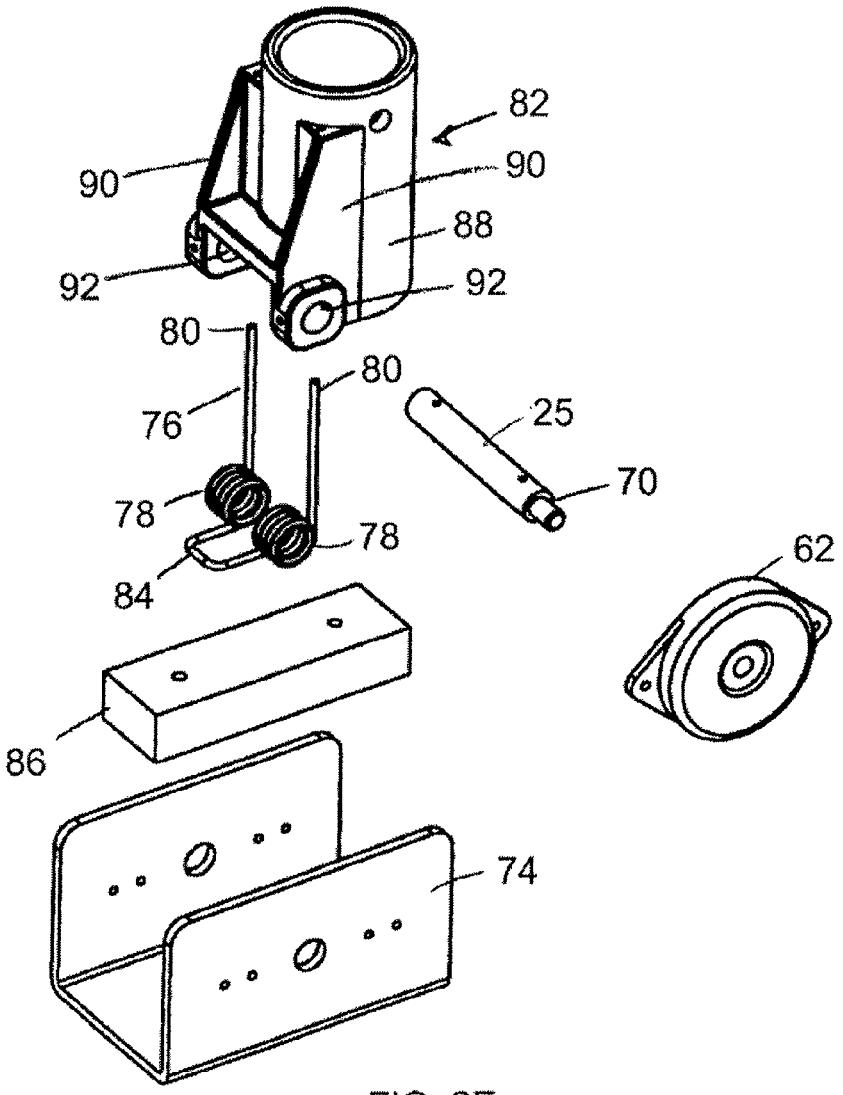
FIG. 2E depicts the damped return mechanism of the second embodiment in a disassembled state.

Referring to FIGS. 2D and 2E, the axle 25 is rotatably mounted to and supported by a support bracket 74. A double torsion spring 76 having two spring portions 78 is provided as the mechanical energy storage device. The axle 24 is received inside of the spring portions 78. Two free ends 80 of the spring 76 are connected to a rotatable swing pole 82, while a connecting portion 84 of spring 76 is biased against a plate 86.

The swing pole 82 includes a cylindrical receptacle portion 88 that receives a proximal end portion of the telescopic swing arm 12 and is fixed thereto preferably with a releasable device or a screw to permit selective assembly and disassembly of the swing arm 12. The swing pole 82 further includes two lobes 90, which are integrated with and extend from the exterior surface of the cylindrical receptacle portion 88.

Preferably, the cylindrical receptacle portion 88 and the lobes 90 are integrated to define a unitary body. Each lobe 90 includes a through opening 92 therein that is sized and shaped to receive a respective end portion of the axle 25. Each lobe 90 is then connected with a screw or the like fastener to the axle 25, whereby the swing pole 82 is permitted to swing about the central longitudinal axis of the axle 25 to store energy in the spring portions 78 (i.e. to load the spring portions 78), when the swing arm 12 swings due, for example, to the striking of the strike target 18 by the batter.

The axle 25 also includes an extension 70 which is connected to the damper 62 in order to provide at least a slow, damped return that takes at least one second but preferably no more than six seconds to return the swing arm to its original, standby position (e.g. the vertical, upright position) from a deflected position at a ninety degree displacement relative to the original, standby position. That is, the damped swing arm 12 returns from a deflected position to its standby position at an average speed in the range fifteen degrees per second to ninety degrees per second.

Referring to FIG. 2A, the bracket 74 is preferably connected with screws or the like to a support plate 94, which serves as the base of the tee 11 in the second embodiment.

Preferably, the screws used to mount the bracket 74 to the support plate 94 also pass through plate 86.

Figure 2F:
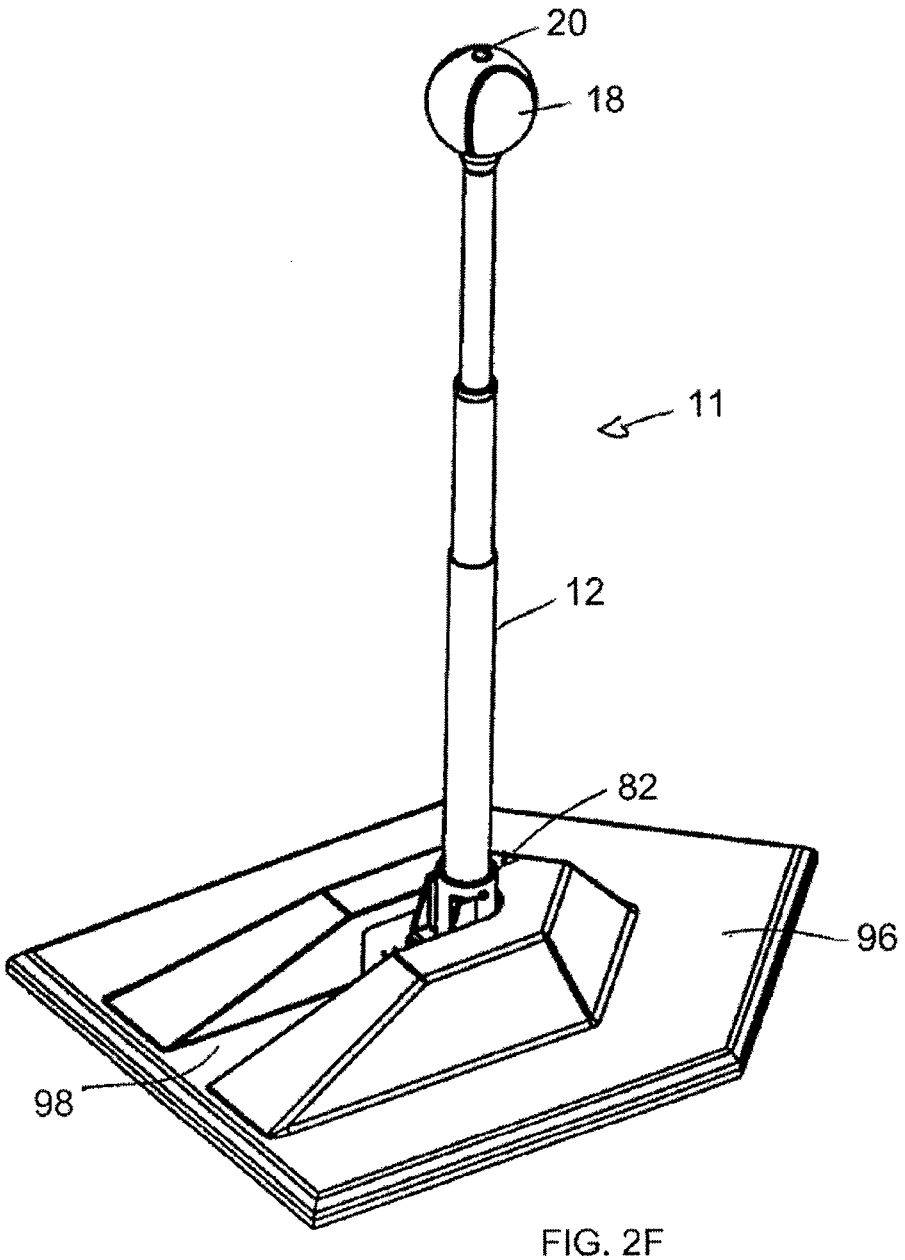
FIG. 2F depicts the second embodiment with a cover residing over its base and the swing arm in a standby position.
Figure 2G:
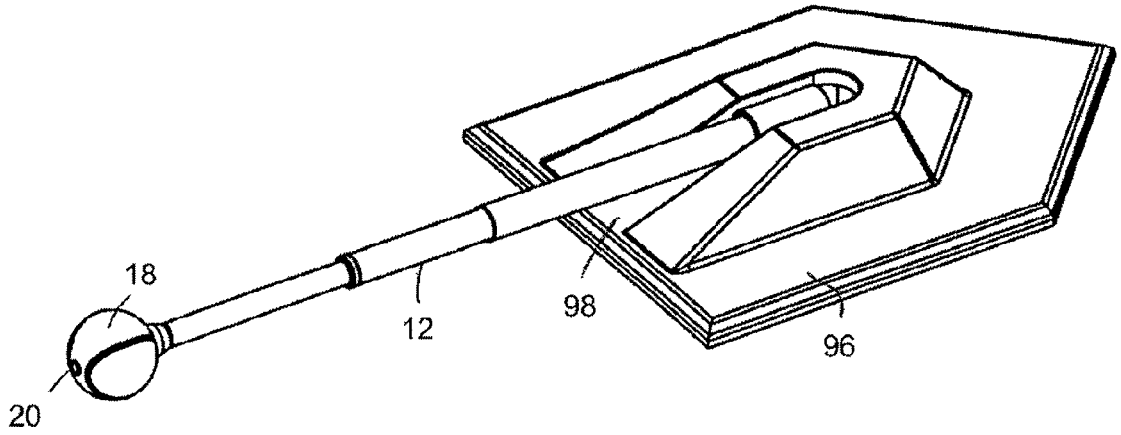
FIG. 2G depicts the second embodiment with its swing arm in a deflected position.
Figure 2H:
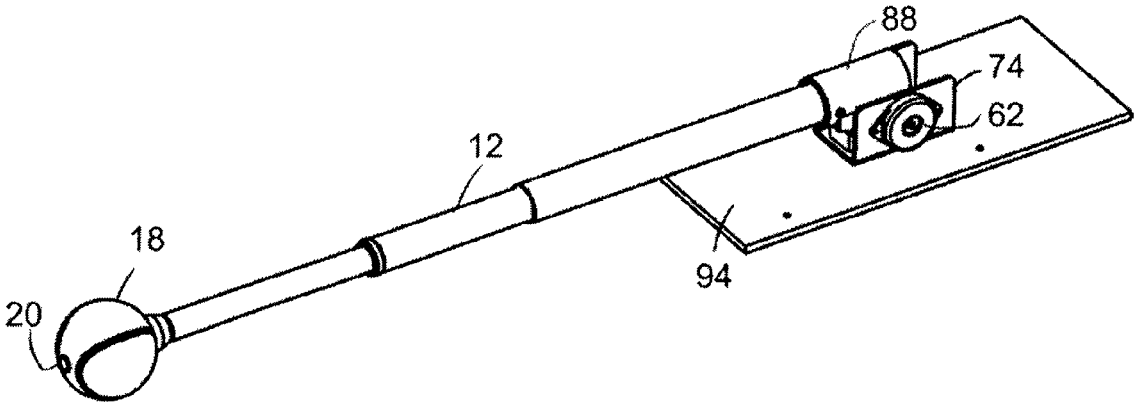
FIG. 2H depicts the second embodiment with its swing arm in the deflected position without the cover.

A cover 96 (FIG. 2F) or the like may be then provide over the support plate 94. The cover 96 may have a channel 98 defined therein which can be used to properly orient and align the tee 11 so the plane of motion (the plane in which the swing arm 12 moves) of the swing arm 12 is properly oriented for the batter.

The cover 96 may be connected to the support plate 94, or may simply reside over the support plate 94 in order to maintain the tee 11 in place.

The cover 96 may be made heavy in order to prevent the tee from tipping over.

Optionally, a protective cover such as a foam padding or the like may be releasably attached to at least a part of the tee to provide protection against mis-swings by the batter. For example, a foam padding or the like may be slipped over the adjustable pole 38 and releasably secured around the pole with a strip of VELCRO (hook and loop fastener) or the like.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A batting tee, comprising:

a swing arm having a distal end and a proximal end;

a strike target integrated with the distal end of the swing arm; and a return mechanism including a rotatable axle having a rotation axis and connected to the proximal end of the swing arm, a mechanical energy storage device arranged to store mechanical energy when the swing arm swings about the rotation axis of the axle in one direction from a standby position to a deflected position angularly displaced from the standby position, and a damper arranged to slow down rotation of the swing aim from the deflected position to the standby position under force supplied by energy stored in the mechanical energy storage device;

a housing having a chamber with an open top and an open bottom, wherein the axle is rotatably mounted in the chamber, the housing including a gap extending to the chamber to permit the swing aim to swing through the gap from the open top to the open bottom of the chamber, wherein the housing further comprises an integrated collar to define a unitary body with the housing, wherein the axle includes ends and a lug located between the ends, the lug being connected to a proximal end portion of the swing arm, wherein the housing includes two bores each receiving a respective end portion of the axle therein, and wherein the mechanical energy storage device includes two torsion springs each located between the lug and a respective bore in the housing.

2. The batting tee of claim 1, wherein the damper resides on an exterior surface of the housing, and the axle includes an extension which passes through the housing and is connected to the damper.

3. A batting tee, comprising:

a swing arm having a distal end and a proximal end;

a strike target integrated with the distal end of the swing arm; and a return mechanism including a rotatable axle having a rotation axis and connected to the proximal end of the swing arm, a mechanical energy storage device arranged to store mechanical energy when the swing arm swings about the rotation axis of the axle in one direction from a standby position to a deflected position angularly displaced from the standby position, and a damper arranged to slow down rotation of the swing arm from the deflected position to the standby position under force supplied by energy stored in the mechanical energy storage device;

a housing having a chamber with an open top and an open bottom, wherein the axle is rotatably mounted in the chamber, the housing including a gap extending to the chamber to permit the swing arm to swing through the gap from the open top to the open bottom of the chamber, wherein the housing further comprises an integrated collar, wherein the axle includes ends and a proximal end portion of the swing arm is connected to the axle between the ends, wherein the housing includes two openings each receiving a respective end portion of the axle therein, and wherein the mechanical energy storage device includes at least one spring disposed around the axle and located between the proximal end portion of the swing arm and one of the ends of the axle.

* * * * *